US008261818B2

(12) United States Patent
Pallini et al.

(10) Patent No.: US 8,261,818 B2
(45) Date of Patent: Sep. 11, 2012

(54) SELF-INSERTING SEAL ASSEMBLY

(75) Inventors: Joseph W. Pallini, Tomball, TX (US); Rockford D. Lyle, Pinehurst, TX (US); Chii-Ren Lin, Bellaire, TX (US)

(73) Assignee: Vetco Gray Inc., Houston, TX (US)

( * ) Notice: Subject to any disclaimer, the term of this patent is extended or adjusted under 35 U.S.C. 154(b) by 566 days.

(21) Appl. No.: 12/469,514

(22) Filed: May 20, 2009

(65) Prior Publication Data

US 2010/0294486 A1 Nov. 25, 2010

(51) Int. Cl.

| | |
|---|---|
| ***E21B 23/00*** | (2006.01) |
| ***E21B 23/02*** | (2006.01) |
| ***E21B 49/10*** | (2006.01) |
| ***E21B 19/00*** | (2006.01) |

(52) U.S. Cl. ..... 166/206; 166/120; 166/88.1; 73/152.26

(58) Field of Classification Search ..... 166/73, 166/120, 134, 182, 196, 217, 220, 240, 237, 166/336, 337, 382, 88.4, 88.3, 93.1, 88.1, 166/75.13, 206; 285/302, 322; 294/86.15, 294/86.14; 73/152.26

See application file for complete search history.

(56) References Cited

U.S. PATENT DOCUMENTS

| | | | | |
|---|---|---|---|---|
| 3,087,547 | A * | 4/1963 | Raulins et al. | 166/89.1 |
| 4,273,372 | A * | 6/1981 | Sheshtawy | 294/86.15 |
| 4,634,152 | A * | 1/1987 | Pettit | 285/39 |
| 4,911,244 | A * | 3/1990 | Hynes | 166/368 |
| 6,202,745 | B1 * | 3/2001 | Reimert et al. | 166/115 |
| 6,978,839 | B2 * | 12/2005 | Fenton et al. | 166/348 |
| 2009/0194291 | A1 * | 8/2009 | Fesi et al. | 166/369 |
| 2009/0277645 | A1 * | 11/2009 | Pallini et al. | 166/345 |

* cited by examiner

*Primary Examiner* — Giovanna Wright
*Assistant Examiner* — Michael Wills, III
(74) *Attorney, Agent, or Firm* — Bracewell & Giuliani LLP

(57) ABSTRACT

A self-inserting seal assembly that sets a seal at a well component to allow for pressure testing of the well component. The seal assembly can be landed on a well component with an ROV. A seal is located on the lower portion of a lower body in the assembly. A set of outer dogs lock with a grooved mating profile formed on the well component to lock the outer housing to provide a reaction point for setting the seal, which may require several thousand pounds of force. A set of inner dogs lock with a grooved mating profile formed on the inner diameter of the outer housing. This locks the lower body to the outer housing to ensure the seal remains set in place. After the well component is pressure tested, the seal assembly can be unlocked and retrieved from the well via an ROV.

26 Claims, 5 Drawing Sheets

SELF-INSERTING SEAL ASSEMBLY

FIELD OF INVENTION

This invention relates in general to seal assemblies and in particular to a seal assembly for a plug that can be used to seal and test a well component.

BACKGROUND OF THE INVENTION

A typical subsea wellhead assembly has a high pressure wellhead housing supported in a lower pressure wellhead housing and secured to casing that extends into the well. One or more casing hangers land in the wellhead housing, the casing hanger being located at the upper end of a string of casing that extends into the well to a deeper depth. A string of tubing extends through the casing for production fluids.

Well components are pressure tested after installation to detect leaks. A plug comprising a seal can be used to pressure test the well components. The plug can be landed at a tubular well component and the seal can be set to establish a seal at the well component. The portion of the well below the plug can then be hydraulically pressurized from a remotely operated vehicle ("ROV") or via a hydraulic line from the surface to thereby pressure test the well components below the plug. The plug is usually removed after testing of the well component but can remain in place until a later time when other components, such as a tree, are installed. The pressure tested well component can be, for example, a wellhead housing, a tree, a gooseneck connection, or a pigging head. Further, the integrity of riser components can also be pressure tested by setting the plug in the riser. One example of riser component to be pressure tested would be a gooseneck connection at the top of a freestanding riser.

The plug's seal is typically set using the plug's own weight. This weight-activated plug setting approach is adequate to set seals with a setting force of a few hundred pounds. However, plug seals used to conduct high pressure tests of well components can require setting forces of approximately 2,000 psi, depending on size. The weight of the plug is thus insufficient to set these high pressure seals that can be rated for test pressures of up to 15,000 psi.

One approach attempting to address the shortcomings of weight activated setting calls for the use of a tool or an ROV to set plugs with seals having a higher setting force. The tool or ROV can screw in a plug having a seal with up to a 5000 psi setting force. However, the force applied by an ROV may also be insufficient to set a seal assembly for a plug rated for test pressures of 15,000 psi or more.

A need exists for a technique that addresses the seal setting problems described above. In particular a need exists for a technique to set a high pressure plug seal for testing well components. The following technique may solve these problems.

SUMMARY OF THE INVENTION

In an embodiment of the present technique, a self-inserting seal assembly is provided that can allow high pressure seals in plugs to be set in well and riser components. The well and riser components can then be pressure tested to detect leaks after installation. The self-inserting seal assembly can be ROV installable and retrievable.

In the illustrated embodiment, the self-inserting seal assembly has a hydraulically actuated piston rod inside an inner housing having a seal portion, an outer housing, and landing support. The assembly comprises an outer set of dogs and an inner set of dogs. The outer set of dogs is initially recessed in the outer housing and in contact with the seal portion. As an actuator connected to the lower end of the piston rod is forced downward, the outer dogs move outward to engage a mating profile formed on the well component. This locking engagement between the outer dogs and the mating profile of the well component provides a reaction point that allows the seal located at the bottom part of the seal portion to come into sealing engagement with the well component. Continued downward movement of the actuator forces an inner set of dogs to lockingly engage with a set of grooves formed on the interior of the outer housing to hold the seal portion and thereby the seal in place. The well or riser components can then be pressure tested via a port in the assembly.

In the illustrated embodiment, upon completion of testing, the self-inserting seal assembly can be unlocked by the ROV by retracting the inner dogs and pulling the seal portion up to unset the seal. Continued movement upward of the seal portion causes the outer dogs to retract and allows the retrieval of the assembly by the ROV.

The combination of reaction points provided by the locking mechanisms of the dogs with the mating profiles, and the hydraulically actuated piston rod, provides the setting force needed to set the high pressure seals used to test well and riser components.

DETAILED DESCRIPTION OF THE INVENTION

Figure 1:
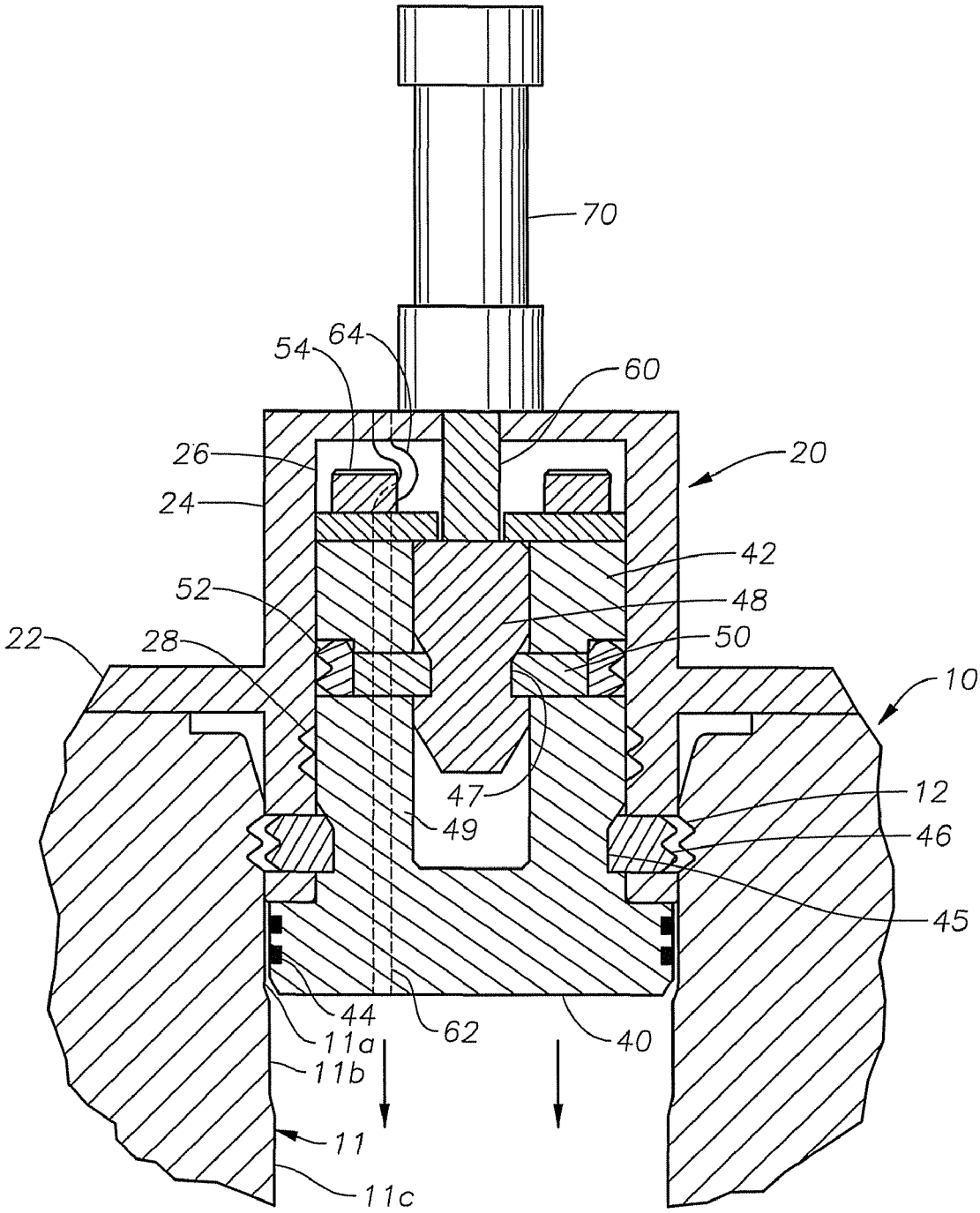
FIG. 1 is a sectional view of a self-inserting seal assembly landed on a well component with the outer dogs in alignment with the mating profile of the well component, in accordance with an embodiment of the invention.

Referring to FIG. 1, an embodiment of the invention shows a portion of a well component 10, such as, for example a wellhead housing. Well component 10 is located at an upper end of a well and serves as a wellhead member in this example. Alternately, well component 10 could be a riser component instead of a wellhead member. The well component 10 has an inner diameter located therein.

In this example, the well component 10 comprises a bore 11 having a mating profile 12 formed on the inner diameter. The mating profile 12 can be comprised of annular grooves that interrupt the profile of the inner diameter. Bore 11 has an upper portion 11*a* and an annular seal surface 11*b* directly below. Seal surface 11*b* is smaller in diameter than bore upper portion 11*a*. A lower portion 11*c* is directly below seal surface 11*b* and can have a smaller inner diameter than the inner diameter of the seal surface 11*b*. However, it is not a requirement that the inner diameter of the lower portion 11*c* be smaller that that of the seal surface 11*b*.

Well component 10 provides a shoulder to land a self-inserting seal assembly 20. The self-inserting seal assembly 20 comprises an external flange or landing support 22 that rests on the shoulder of the well component 10.

The self-inserting seal assembly 20 further comprises a cylindrical outer housing 24 having a cylindrical inner surface 26 that, like the well component, has an annular grooved mating profile 28. A set of outer dogs 46 can move outward to engage the grooved mating profile 28 during installation to lock the outer housing 24 to the well component 10. However, other devices may be used to lock the outer housing 24 to the well component. For example, a split ring may be used to lock the outer housing 24 to the well component. The split-ring may be biased to expand outward to engage the mating profile 28. Landing support 22 joins and extends radially outward from outer housing 24. A seal portion 40 carrying a seal 44 on its bottom portion is partially housed within the outer housing 24 and is in axial sliding engagement with the outer housing 24. Seal portion 40 has an outer diameter equal or larger than the diameter of outer housing 24 below landing support 22. The seals 44 can be of the Polypak or S-Seal type. The seal portion 40 is integrally connected to an inner housing 42 and defines an opening in which a set of transfer pins or rods 50 sit. Recesses 45 formed on the inner housing 42 serve to initially house the interior ends of the outer dogs 46 before the outer dogs 46 extend during installation. The transfer rods 50 can move radially to force the inner dogs 52 outward in response to axial movement of an actuator 48 within a cavity 49 in the seal portion 40 and the inner housing 42. Recesses 47 formed on the actuator 48 serve to hold the interior ends of the transfer rods 50 when retracted. Transfer rods 50 and inner dogs 52 serve as a locking member to lock inner housing 42 in a lower portion in outer housing 24. A plurality of fasteners 54 fasten a top plate to the inner housing 42. A piston rod 60 that can extend and retract from a double-action hydraulic cylinder 70 connects to the actuator 48 to move it upwards and downwards relative to the seal portion 40 and the inner housing 42.

The sequence of the installation operation is shown in FIGS. 1 to 4. FIG. 1 shows an embodiment of the self-inserting seal assembly 20 landed on a well component 10 such as a wellhead housing. The seal assembly 20 can be carried to and landed on the well component 10 by an ROV (not shown) or a running/setting tool (not shown). The seal assembly 20 initially sits on the well component 10 with the seal 44 spaced by a clearance from the bore upper portion 11*a* of the well component 10. The outer dogs 46 are initially retracted within the outer housing 24 and aligned with the grooved mating profile 12 formed on the bore of the well component 10. Inner dogs 52 are also retracted and spaced above grooved mating profile 28.

Figure 2:
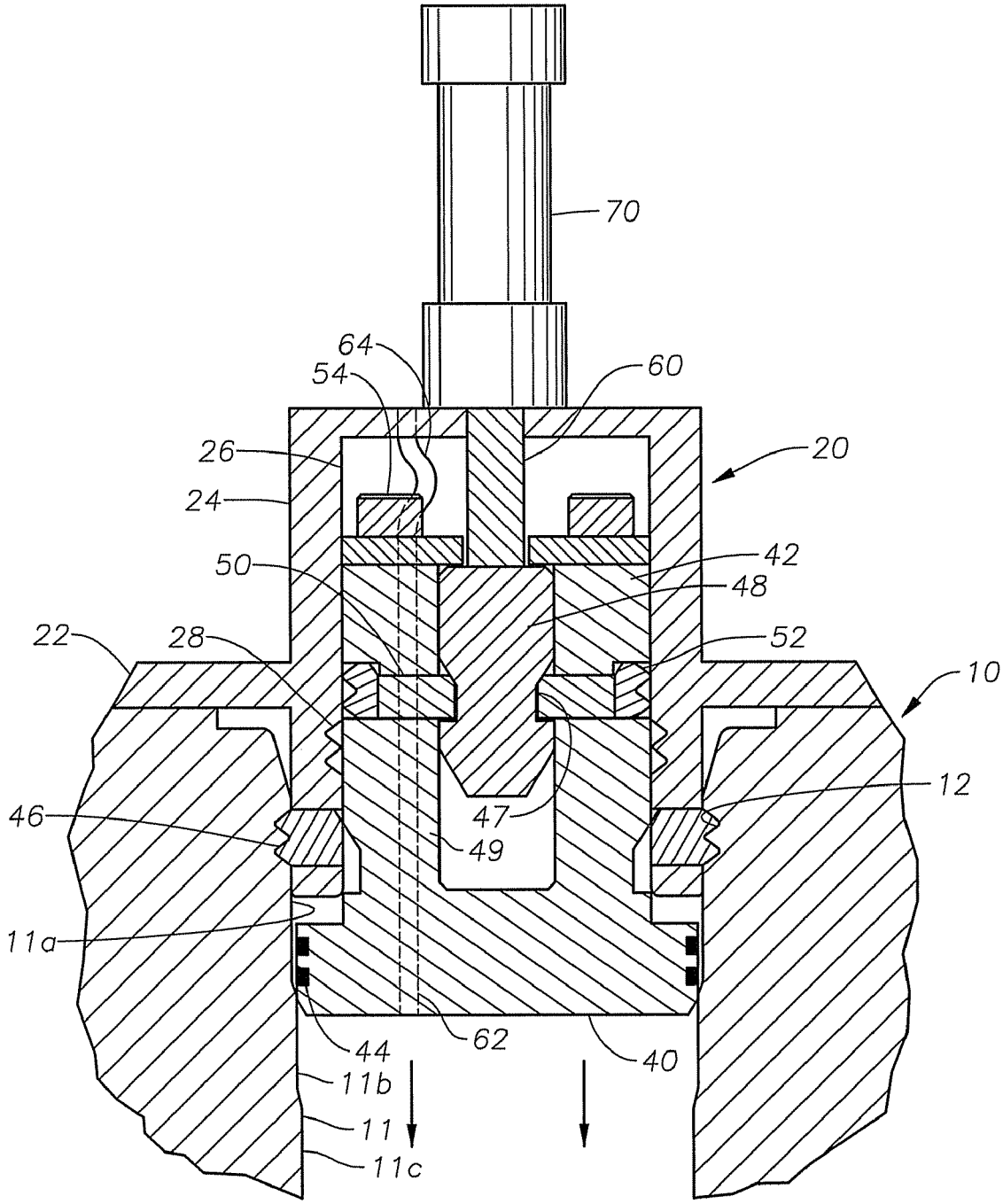
FIG. 2 is a sectional view of the self-inserting seal assembly of FIG. 1 with the outer dogs forced outwards into the mating profile of the well component, in accordance with an embodiment of the invention.

Referring to FIG. 2, when hydraulic pressure from a hydraulic source (not shown) on the ROV or at the surface is applied to the piston rod 60 through the double-action hydraulic cylinder 70, the piston rod 60, the inner housing 42 and top plate, the actuator 48, the transfer rods 50 and inner dogs 52, and the seal portion 40 all are driven axially outward, relative to the outer housing, in unison. The outward movement of the seal portion 40 forces the outer dogs 46 to slide along an angled surface on the recess and move outward to engage the grooved mating profile 46 in the bore 11 of the well component 10. While the outer dogs 46 are being locked into the grooved mating profile 46, the seals 40 located in the seal portion 40 begin to move without resistance due to clearance in bore upper portion 11*a* of the well component 10. However, a prime mover other than hydraulic pressure may be used to drive the inner housing 42, and other seal assembly components, outward. For example, an ROV may be used to rotate an actuator that is configured to produce axial movement of the inner housing 42.

Figure 3:
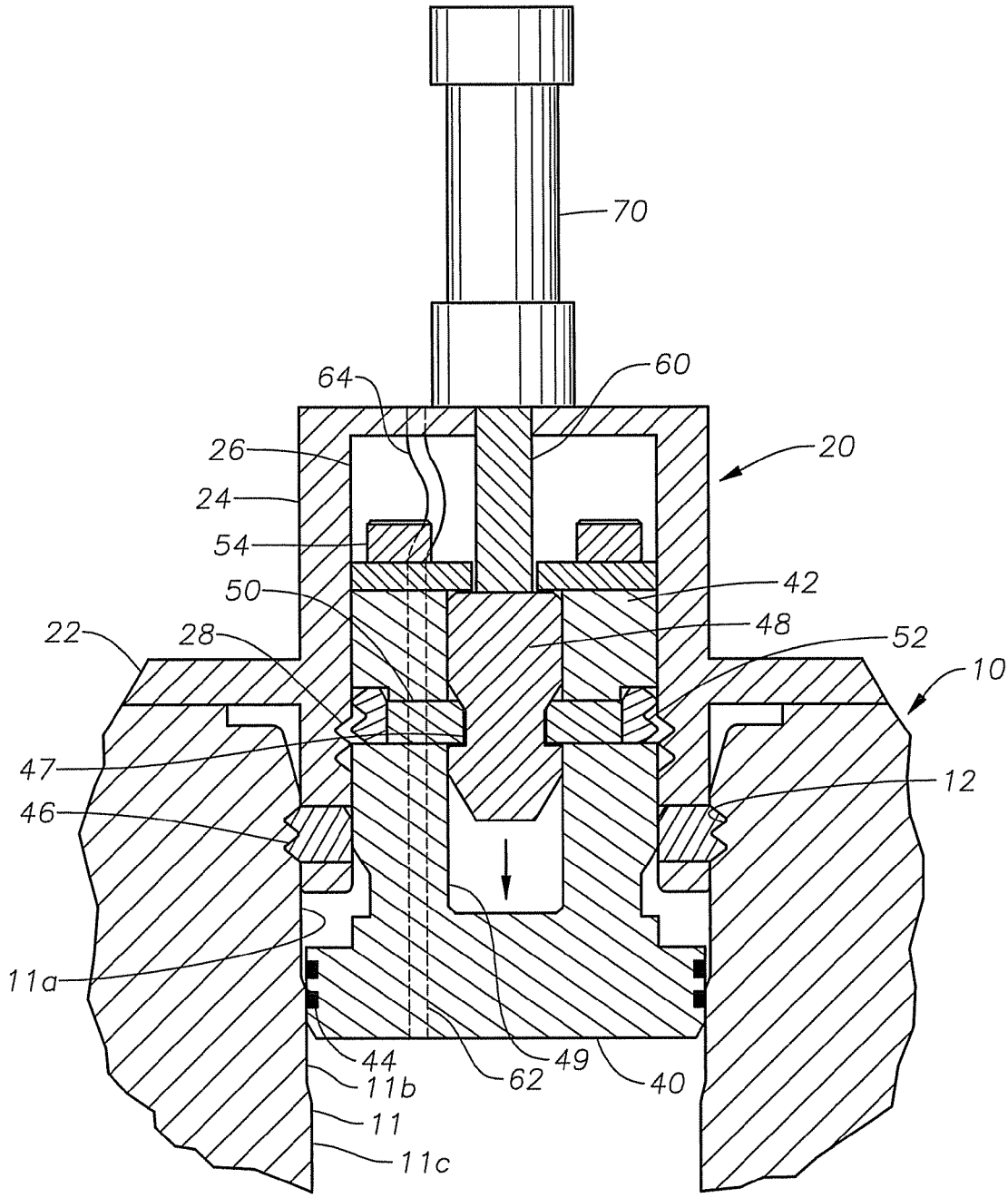
FIG. 3 is a sectional view of the self-inserting seal assembly of FIG. 1 with the seal in contact with the inner diameter of the well component, in accordance with an embodiment of the invention.

Referring to FIG. 3, once the outer dogs 46 are completely locked into the grooved mating profile 46 on the bore of the well component 10, this locking mechanism provides a reaction point for the piston rod 60 to force the seal portion 40 and seal 44 further downward into smaller diameter seal surface 11*b* of the well component 10. This provides the necessary setting force to set the seal 44, which may be several thousand pounds of force. The reaction is through outer dogs 46 into grooved profile 12. At this point, the piston rod 60, the inner housing 42 and top plate, the actuator 48, the transfer rods 50 and inner dogs 52, and the seal portion 40 all continue to extend outward in unison.

Figure 4:
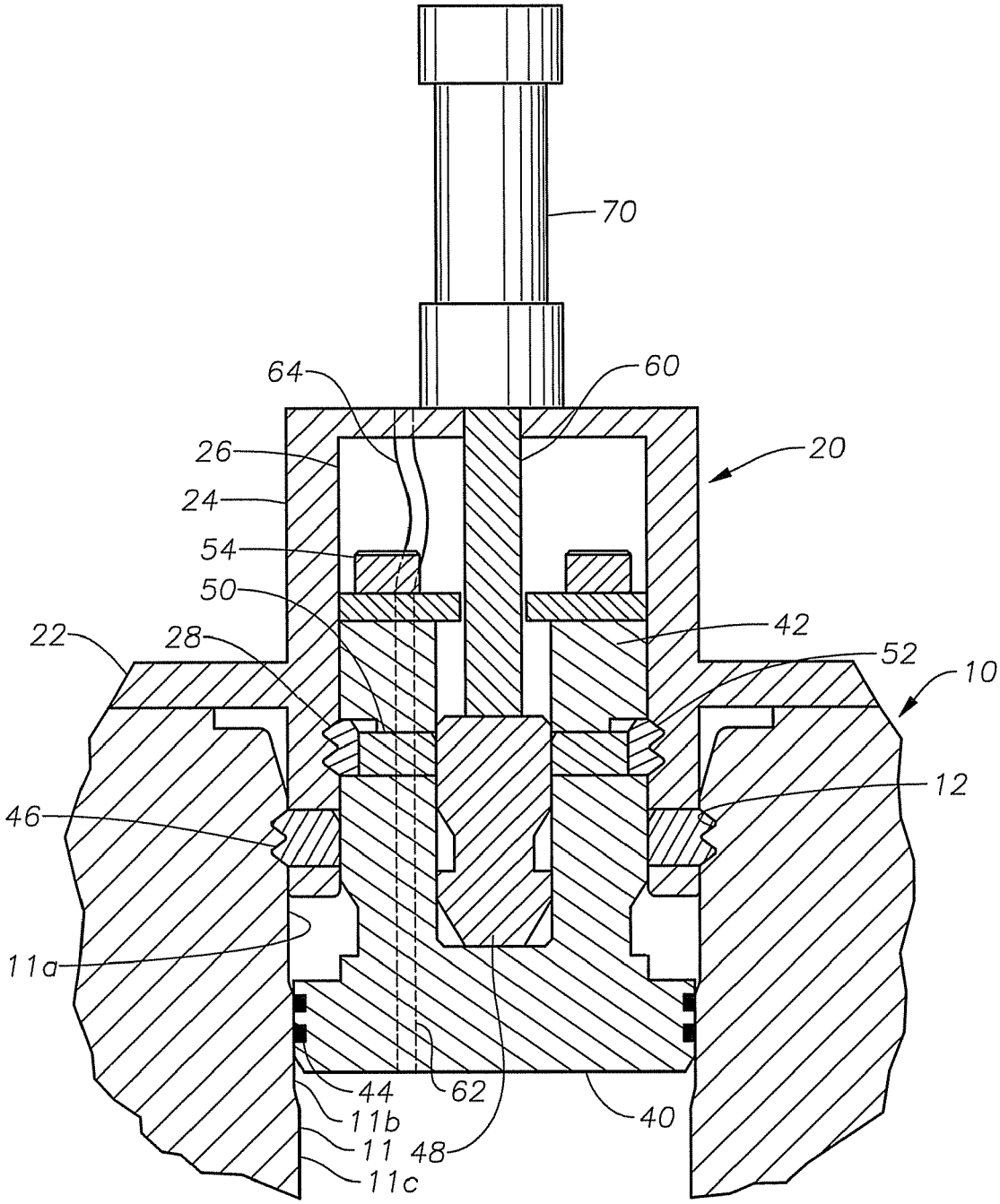
FIG. 4 is a sectional view of the self-inserting seal assembly of FIG. 1 with the inner dogs forced outwards into grooves on the inner surface of the outer housing, in accordance with an embodiment of the invention.

Referring to FIG. 4, as hydraulic pressure continues to be applied to the piston rod 60, the piston rod 60 in turn continues to drive the seal portion 40 downward until the seals 44 are properly engaged to the smaller diameter sealing surface 11*b* of the well component 10. In this embodiment, the lower bore portion 11*c* is smaller in diameter than seals 44 and prevents further downward movement of seal portion 40. Once the seals 44 are properly set, the seal portion 40 ceases to move and piston rod 60 then causes the actuator 48 to move downward, in this embodiment, within the cavity formed by the inner housing 42 and the seal portion 40. The continued outward movement of the actuator 48 relative to the seal portion 40 causes actuator recesses 47 to move below the transfer rods 50 and causes the transfer rods 50 to force the inner dogs 52 into locking engagement with the grooved mating profile 28 formed on the inner diameter of the outer housing 24. The piston rod 60 moves the actuator 48 downward until the bottom portion of the actuator 48 reaches the end of the cavity within the seal portion 40. At this point the locking mechanism of the inner dogs 52 with the grooved mating profile 28 on the inner diameter of the outer housing 24 will lock the seal portion 40 to the outer housing 24 to thereby maintain the seal 44 in place.

Once the seal 44 is set, the well component can be pressure tested. A pressure testing port 62 and flexible line 64 (schematically shown by dotted lines) will traverse the seal portion 40 and the outer housing 24 to place the portion of the well below the seal assembly 20 in communication with a pressure source (not shown) on the ROV or at the surface. Test port 62 does not pass through rods 50 or fasteners 54. In this way, the space below the seal assembly can be pressurized up to 15,000 psi to thereby pressure test the well component 10. Alternatively, the seal assembly can set a seal in a riser component to provide pressure testing for the riser component. The riser component is another type of well component.

Figure 5:
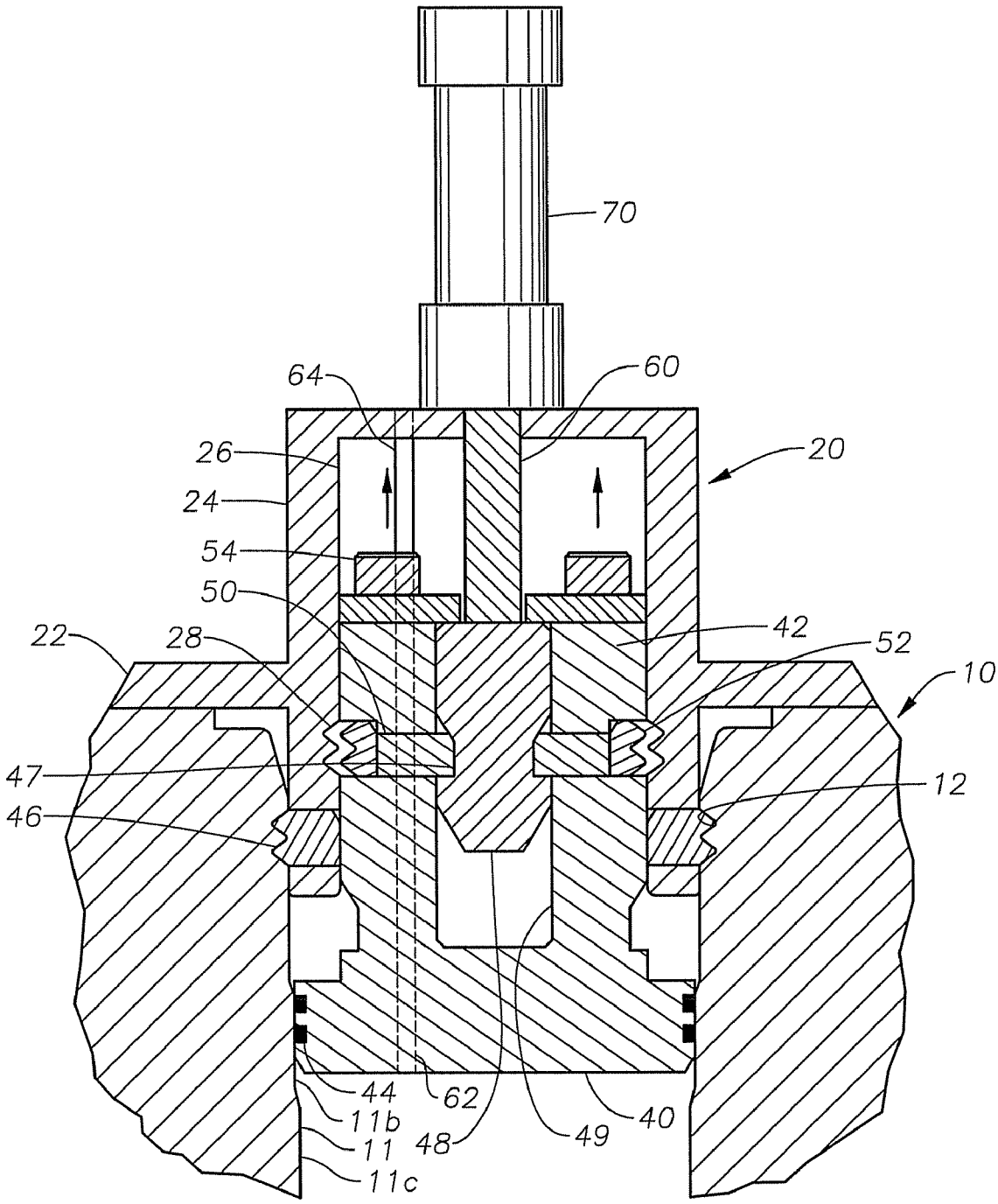
FIG. 5 is a sectional view of the self-inserting seal assembly of FIG. 1 with the inner dogs retracted during retrieval of the assembly, in accordance with an embodiment of the invention.

Referring to FIG. 5, to remove and retrieve the self-inserting seal assembly 20, the sequence of installation is reversed. The double-action hydraulic cylinder 70 retracts the piston rod 60 to pull the actuator 48 up through cavity 49 formed in the inner housing 42 and seal portion 40. Although the tapered profile of the actuator recesses 47 allows for retraction of the transfer rods 50 and inner dogs 52, a spring (not shown) can also be used to aid in retracting the transfer rods 50 and inner dogs 52 inward when the transfer rods 50 align with the recess 47 in the actuator 48. The inner dogs 52 will thereby unlock from the grooved mating profile 28.

The piston rod 60 will continue to pull the actuator 48 up, forcing it up against the plates located fastened to the top of the inner housing 42. The upward force on the actuator 48 is thus transferred to the fastened plate, causing the seal portion 40 to move upward to unset the seals 44. As the recess 45 (FIG. 1) in the seal portion 40 aligns with the outer dogs 46, he tapered profile of the recess 45 allows the outer dogs 46 to retract. A spring (not shown) can also be used to aid in retracting the transfer outer dogs 46 inward. At this point, self-inserting seal assembly 20 will be at a position substantially similar to that illustrated in FIG. 1 and the seal assembly 20. The piston rod 60 then continues to move upwards until the cylinder 70 runs out of stroke, allowing the seal assembly 20 to be lifted out of the well. The seal assembly 20 can then be retrieved by the ROV or a retrieval tool on a string.

While the invention has been shown in only one of its forms, it should be apparent to those skilled in the art that it is not so limited but is susceptible to various changes without departing from the scope of the invention.

What is claimed is:

1. A well component testing apparatus, comprising:

an outer housing for insertion into a bore of a well component;

an outer locking member on the outer housing that engages a profile in the bore of the well component to lock the outer housing to the well component;

an inner housing carried within the outer housing for axial movement relative to an axis of the outer housing between a retracted position and an extended position, the inner housing having a seal portion with a seal protruding from the inner housing in the retracted and extended positions;

an actuator that moves the inner housing to the extended position to cause the seal to engage the bore of the well component; and an inner locking member that engages a profile in the inner diameter of the outer housing to lock the inner housing in the extended position.

2. The apparatus according to claim 1, wherein axial movement of the inner housing in one direction relative to the outer housing causes the outer locking member to move outward and axial movement of the inner housing in an opposite direction relative to the outer housing allows the outer locking member to move inward.

3. The apparatus according to claim 1, wherein axial movement of the actuator in one direction relative to the inner housing causes the inner locking member to move outward and axial movement of the actuator in an opposite direction relative to the inner housing allows the inner locking member to move inward.

4. The apparatus according to claim 1, wherein the inner diameter of the bore of the well component is reduced inwardly below the seal section to less than an outer diameter of the seal section.

5. The apparatus according to claim 1, wherein the bore has an upper section and a lower section separated by a sealing section that is sealingly engaged by the seal, the upper section having a greater inner diameter than the sealing section.

6. The apparatus according to claim 1, wherein the actuator is prevented from moving the inner locking member outward until the outer locking member is moved outward into engagement with the profile in the bore of the well component.

7. The apparatus according to claim 1, wherein the outer housing has a radially extending support member that engages a rim of the well component.

8. The apparatus according to claim 1, further comprising a hydraulic cylinder that engages the actuator to move the actuator axially relative to the outer housing.

9. The apparatus according to claim 1, wherein the actuator having a recess to receive the interior ends of the inner locking member, to force the inner locking member outward in response to the actuator moving downward during installation.

10. A well apparatus with an axis, comprising:

a well component having a bore;

a mating profile formed in the bore;

an outer housing partially within the bore;

a mating profile formed on the inner diameter of the outer housing;

an inner housing located within the outer housing that moves axially within the outer housing during installation;

the inner housing having a seal portion with a seal located on an exterior surface of the seal portion, the seal being in sealing engagement with the bore of the well component during installation;

a set of outer dog assemblies carried by the outer housing forced outward into locking engagement with the mating profile on the bore of the well component during installation;

a set of inner dogs forced outward into locking engagement with the mating profile on the inner diameter of the outer housing of the well component during installation; and an actuator in axial, sliding engagement with the inner housing for moving the inner housing axially.

11. The apparatus according to claim 10, wherein axial movement of the inner housing in one direction relative to the outer housing causes the outer dog assemblies to move outward and axial movement of the inner housing in an opposite direction relative to the outer housing allows the outer dog assemblies to move inward.

12. The apparatus according to claim 10, wherein axial movement of the actuator in one direction relative to the inner housing causes the inner dog assemblies to move outward and axial movement of the actuator in an opposite direction relative to the inner housing allows the inner dog assemblies to move inward.

13. The apparatus according to claim 10, wherein a pressure test port traverses the lower body, the plug housing, and the outer housing, the pressure test port being in communication with the space in the well component opposite the seal portion of the inner housing and a pressurization source outside the outer housing.

14. The apparatus according to claim 10, wherein the bore has an upper section and a lower section separated by a sealing section that is sealingly engaged by the seal, the upper section having a greater inner diameter than the sealing section.

15. The apparatus according to claim 10, wherein the actuator is prevented from moving the inner dog assemblies outward until the outer dog assemblies are moved outward into engagement with the profile in the bore of the well component.

16. The apparatus according to claim 10, wherein the outer housing has a radially extending support member that engages a rim of the well component.

17. The apparatus according to claim 10, further comprising a hydraulic cylinder that engages the actuator to move the actuator axially relative to the outer housing.

18. The apparatus according to claim 10, wherein the actuator having a recess to receive the interior ends of the inner dog assemblies, to force the inner dog assemblies outward in response to the actuator moving downward during installation.

19. A method for sealing, comprising:

landing a well apparatus in a bore of a well component;

locking an outer locking member of an outer housing of the well apparatus to a profile of the bore of the well component;

operating an actuator adapted to drive an inner housing disposed within the outer housing axially relative to the outer housing to extend a seal portion of the inner housing outward into the bore of the well component to bring the seal into contact with a seal section of the bore of the well component;

extending the inner housing outward to force an inner locking member to move outward into locking engagement with a profile formed on an inner diameter of the outer housing to block axial movement of inner housing relative to the outer housing.

20. The method according to claim 19, wherein moving the seal portion of the inner housing is accomplished by applying a hydraulic pressure to a cylinder attached to the actuator thereby cause a piston rod to extend;

wherein moving the actuator within the inner housing is accomplished by applying hydraulic pressure to the cylinder attached to the actuator;

wherein the setting is accomplished by applying hydraulic pressure to the cylinder to thereby cause seal on the lower portion of the inner housing to set against the seal section of the bore of the well component.

21. The method according to claim 20, wherein the hydraulic pressure is provided via an ROV with pressurization capabilities.

22. The method according to claim 19, wherein step of landing a well apparatus comprises using an ROV to land the well apparatus on the well component.

23. The method according to claim 19, wherein step of extending the inner housing outward further comprises forcing the inner locking member outward using a plurality transfer rods, the exterior ends of the transfer rods connected to the interior of the inner locking member, the interior ends of the transfer rods initially in contact with a plurality of recesses formed on the actuator.

24. A seal assembly, comprising:

a seal assembly housing comprising a first locking member adapted to secure the seal assembly housing to a well component;

a movable member adapted to travel within the seal assembly housing from a first axial position relative to the seal assembly housing to a second axial position relative to the seal assembly housing, the movable member comprising:

a seal located on an exterior surface of the movable member and adapted to form a seal against a bore of the well component when the movable member is located in the second axial position relative to the seal assembly housing; and a second locking member adapted to secure the movable member in the second axial position relative to the seal assembly housing.

25. The seal assembly as recited in claim 24, comprising an actuator adapted to drive the movable member between the first and second axial positions relative to the seal assembly housing.

26. The seal assembly as recited in claim 25, wherein the actuator is hydraulically operated.

* * * * *